US010842297B2

(12) United States Patent
Meuti

(10) Patent No.: US 10,842,297 B2
(45) Date of Patent: Nov. 24, 2020

(54) PAPERCRAFT DISPLAY

(71) Applicant: REDBOX S.R.L., Pomezia (IT)

(72) Inventor: Diego Meuti, Pomezia (IT)

(73) Assignee: REDBOX S.R.L., Pomezia (IT)

( * ) Notice: Subject to any disclaimer, the term of this patent is extended or adjusted under 35 U.S.C. 154(b) by 60 days.

(21) Appl. No.: 16/261,872

(22) Filed: Jan. 30, 2019

(65) Prior Publication Data

US 2019/0231093 A1 Aug. 1, 2019

(30) Foreign Application Priority Data

Jan. 30, 2018 (IT) ..... 102018000002127
Jul. 13, 2018 (IT) ..... 102018000007158

(51) Int. Cl.
*A47F 5/11* (2006.01)
*A47B 96/14* (2006.01)
(Continued)

(52) U.S. Cl.
CPC ..... *A47F 5/116* (2013.01); *A47B 57/10* (2013.01); *A47B 96/14* (2013.01);
(Continued)

(58) Field of Classification Search
CPC . A47F 5/116; A47B 96/14; A47B 2230/0081; A47B 2220/0086; A47B 57/10; G09F 5/00; G09F 23/00
See application file for complete search history.

(56) References Cited

U.S. PATENT DOCUMENTS 1,895,725 A * 1/1933 Nuckols ..... A47F 5/112
108/100
3,549,019 A * 12/1970 Kahler ..... A47F 5/116
211/135
(Continued)

FOREIGN PATENT DOCUMENTS

AU 15070/83 A 12/1984
DE 90 00 543 U1 3/1990
(Continued)

OTHER PUBLICATIONS

European Search Report dated Apr. 2, 2019, in corresponding European patent application No. 19153727.3; 8 pages.
(Continued)

*Primary Examiner* — Ko H Chan
(74) *Attorney, Agent, or Firm* — Maier & Maier, PLLC

(57) ABSTRACT

A papercraft display unit including two sidewalls, each having a rear edge and a front edge, a back wall arranged between the two sidewalls at the respective rear edges, and at least one shelf arranged transversally to the walls and associated therewith so as to be locked in position. Each of the sidewalls includes at least at the front edge, three layers of a paper or paper-like material in succession, and, precisely, a first layer or outer layer, a second layer or intermediate layer, and a third layer or inner layer. Furthermore, the intermediate layer of each of the two sidewalls has at least one intermediate slot, the inner layer of each of the two sidewalls has at least one shaped portion in correspondence of the at least one intermediate slot of the intermediate layer, and the at least one shelf has a front edge including two protruding side fins.

23 Claims, 13 Drawing Sheets

(51) Int. Cl.
*A47B 57/10* (2006.01)
*G09F 5/00* (2006.01)
*G09F 23/00* (2006.01)

(52) U.S. Cl.
CPC ..... *A47B 2220/0086* (2013.01); *A47B 2230/0081* (2013.01); *G09F 5/00* (2013.01); *G09F 23/00* (2013.01)

(56) References Cited

U.S. PATENT DOCUMENTS 3,687,091 A * 8/1972 Boylan ..... A47B 43/02 108/60
3,863,575 A * 2/1975 Kuns ..... A47B 43/02 108/179
3,987,737 A * 10/1976 Smith ..... A47F 5/116 108/179
4,271,766 A * 6/1981 Schmiedeler ..... A47B 43/02 108/115
4,519,319 A * 5/1985 Howlett ..... A47F 5/116 108/180
5,145,244 A 9/1992 Kersting
5,392,902 A * 2/1995 Vlastakis ..... A47B 57/00 108/165
6,135,033 A * 10/2000 Deferrari ..... A47F 5/116 108/165
6,302,283 B1 * 10/2001 Yeh ..... A47F 5/116 108/109
10,624,472 B2 * 4/2020 Lopez Fernandez ... A47F 5/116
2003/0160015 A1 * 8/2003 Broerman ..... A47F 5/116 211/149
2013/0062294 A1 3/2013 Beaty
2013/0109556 A1 * 5/2013 Fischer ..... A47F 5/116 493/324
2015/0068998 A1 3/2015 Smith

FOREIGN PATENT DOCUMENTS

DE 102007055301 A1 5/2009
EP 2181627 BI 6/2013
EP 2705778 A1 3/2014
EP 2526839 BI 8/2017
WO 2007/148963 A2 12/2007

OTHER PUBLICATIONS

Search Report dated Aug. 2, 2018 in corresponding Italian Application No. 201800002127; 8 pages.

* cited by examiner

PAPERCRAFT DISPLAY

FIELD

The present invention relates to a papercraft display unit and an assembly of blanks for the formation of said display unit.

The invention refers to the field of display units, in particular for the transport and point-of-sale display of products, for displaying and drawing attention to the products contained and acting as a support for advertising material.

Reference will be made hereinafter to a papercraft product, referring to the industry of paper o paper-like materials in which sheets of paper, cardboard or kindred plastic materials, such as PMMA, Polionda, polystyrene, etc. are converted by means of a cutting and creasing/engraving/folding process in order to obtain semi-finished products for printing, packaging or the creation of display units.

In particular, the invention refers to floor display units, which are generally larger in size than counter display units, the latter being typically used to display products of small dimensions in public establishments such as bars or pubs.

BACKGROUND

It is known that the current floor display units are made of plastic or metal material, or else wood, and more in general with a material whose mechanical and structural characteristics are such as to ensure a sufficient capacity to support the weight of the structure of the display unit and of the products accommodated in the display unit itself.

Recently, display units made of paper or paper-like material have been proposed, with the limit of relying on particular plastic or metal elements designed to enable the assembly of the display unit and the shelves thereof, as well as to impart the necessary characteristics of stiffness to the various elements of the display unit. However, the mixed composition of this new type of display unit gives rise to difficulties in the disposal of the display unit at the end of its life. In fact, for the purposes of correct disposal, the components made of materials that cannot be jointly disposed of must be separated from the others, something that is absolutely not easy and not always possible for the end user, who is often unaware of the presence of at least some of such elements.

Furthermore, compared to display units made of traditional materials, such as, for example, wood, metal or plastic, the display units made of paper or paper-like material have a series of usage limitations, due to the material they are largely made of. In fact, in order not to have too many points of weakness in the structure made of paper or paper-like material, these display units have a non-modifiable configuration—in particular they do not allow the position of the shelves to be changed—and they are not modular—in particular they do not allow the stacking of several display elements utilisable both individually and in association with others of the same type.

SUMMARY

The solution according to the present invention fits into this context; it aims to provide a display unit made of paper or paper-like material that can offer the user a structure which is easy to assemble and may be easily disposed of, being prevalently made up of a single easily recyclable material, for example cardboard.

The basic aim of the present invention is also to provide the end user with a highly resistant product, capable of offering a considerable resistance in terms of compression.

The aim of the present invention is thus to provide a papercraft display unit which makes it possible to overcome the limits of the display units according to the prior art and to obtain the technical results previously described.

A further aim of the invention is that said papercraft display unit can be made at a substantially low cost, both as regards the production costs and as concerns the costs of assembly and adaptation to the requirements of the end user.

Yet a further aim of the invention is to provide a papercraft display unit that is simple, safe and reliable.

Furthermore, an aim of the present invention is to obtain a papercraft display that is rapid to assemble and, at the same time, when disassembled, enables a reduction in transport costs.

It is object of the present invention a papercraft display unit comprising two sidewalls, each having a rear edge and a front edge, a back wall arranged between the two sidewalls at the respective rear edges, and at least one shelf arranged transversally to said walls and associated therewith so as to be locked in position, said display unit being characterised in that each of said sidewalls comprises, at least at the front edge, three layers of a paper-like material in succession, and, precisely, a first layer or outer layer, a second layer or intermediate layer, and a third layer or inner layer, in that said intermediate layer of each of said two sidewalls has at least one intermediate slot, in that said inner layer of each of said two sidewalls has at least one shaped portion in correspondence of said at least one intermediate slot of said intermediate layer, in that said at least one shelf has a front edge comprising two protruding side fins, in that each of said two protruding side fins of said shelf is adapted to be inserted into at least a first portion of the respective intermediate slot obtained in the intermediate layer of the respective sidewall, so that the front edge of the shelf rests laterally at least on a portion of the lower edge of each shaped portion of the inner layer of the respective sidewall.

Again according to the invention, each said shaped portion can be an indent and said shelf can be adapted to be inserted in the respective intermediate slot so that the front edge of the shelf rests laterally on each indent of the inner layer of the respective sidewall, laterally locking the shelf in position, and said at least one shelf can have at least one side connection element between the front edge and the resting portion of the shelf, said at least one side connection element being adapted to be inserted between the inner layer and the intermediate layer at the indent of the respective sidewall when the shelf is associated with the sidewall.

Furthermore, according to the invention, each sidewall can have an upper edge, arranged between said front and rear edges, said indent can have a concavity with the concave portion turned towards said upper edge, so as to guide, with a substantially top-down movement, the insertion of said shelf into said intermediate slot.

Alternatively, according to the invention, said shaped portion can be an inner slot, said at least one lower edge portion of said inner slot can be coplanar with a lower edge portion of said intermediate slot so that at least a portion of said protruding side fins rests at least on a portion of both said lower edges and said sidewalls can be configured so as to facilitate the insertion of said shelf into said inner slot and intermediate slot with a lateral movement from a substantially open position, in which said sidewalls are substantially coplanar with said back wall, to a final position, in which said sidewalls are substantially transversal to said back wall.

Furthermore, according to the invention, said inner layer of each sidewall can comprise at least one inner fin for each shelf, said at least one inner fin comprising a terminal portion, and said at least one shelf can be formed by at least two layers of a paper or paper-like material, said terminal portion of said at least one inner fin being inserted inside the space between said at least two layers.

Again according to the invention, said at least one inner fin can be obtained by means of cuts and folds of said inner layer, said inner fin having at least one fold line in common with said inner layer.

Moreover, according to the invention, a further intermediate layer of paper or paper-like material can be fixed onto said inner fins, adapted to be inserted into slots obtained on said intermediate layer of said sidewalls.

Preferably, according to the invention, said further intermediate layer of said inner fins and the respective slots can comprise magnetic coupling means adapted to stabilise said display unit, when formed.

Further according to the invention, said layers can be three sheets of a same paper or paper-like material or of a different paper or paper-like material, coupled to each other, for example by gluing.

Alternatively, according to the invention, said layers can be three different portions of a same blank which, by means of cuts and folds, is made adapted to form the sidewall of the display unit.

Further according to the invention, the front edge of each at least one shelf can correspond to the thickness of the shelf itself, or else, again according to the invention, the front edge of each at least one shelf can have a height that is greater than the thickness of the shelf, so as to be able to be used for applying decorations or graphics.

Also according to the invention, the protruding side fins of each at least one shelf can protrude laterally relative to the width of the shelf, as a total or partial extension of the front edge.

Again according to the invention, said display unit can comprise two or more shelves, and each sidewall can have a respective intermediate slot—shaped portion pair for each shelf, distanced from each other in relation to the height at which the shelf is positioned.

Finally, according to the invention, the rear wall can comprise a longitudinal fin adapted to be associated with the rear edge of the shelf so as to hold it in position.

Furthermore, it is object of the present invention relates a kit of flat blanks for forming a display unit according to the present invention, said kit of blanks comprising:

a first flat blank for forming a sidewall, said first blank having an inner face, on said inner face there being obtained on said inner face two first fold lines parallel to each other which divide it into a central panel, intended to become the outer layer of the sidewall of the display unit, and two side panels intended to become the intermediate layer and the inner layer of the sidewall of the display unit, said first side panel having at least one intermediate slot, and the second side panel having at least one shaped portion, arranged so that after folding at the two first creases with a valley-fold relative to the inner face of the first blank, the first side panel is arranged on said central panel and the second side panel is arranged on said first side panel so that said shaped portion is in a position in correspondence of said at least one intermediate slot of the first side panel, obtaining a sidewall of the display unit;

a second flat blank intended to become the rear or back wall of the display unit according to the invention, said second blank having at least one cut adapted to become the longitudinal fin of the display unit;

a third flat blank intended to become the at least one shelf of the display unit according to the invention, said third flat blank having an inner face in which at least one fold line is obtained, and wherein the shelf is obtained by folding said at least one fold line with a mountain-fold relative to the inner face, wherein the edge corresponds to at least one fold line.

Preferably, according to the invention, the width of the edge of said third flat blank can be greater than the rest of the body of the third blank so as to form the two protruding fins of the shelf of the display unit.

Finally, according to the invention, said third flat blank can comprise a longitudinal fin at the front edge adapted to become the connecting element of the shelf of the display unit, and said longitudinal fin can have two creases orthogonal to each other, so that when the third blank is assembled into a shelf, one portion of the longitudinal fin is locked between the edge and the resting surface of the shelf and the other portion forms the connecting element.

BRIEF DESCRIPTION OF THE DRAWINGS

The invention will now be described by way of illustration and not by way of limitation, with particular reference to the drawings of the appended figures, in which.

DETAILED DESCRIPTION

Figure 1:
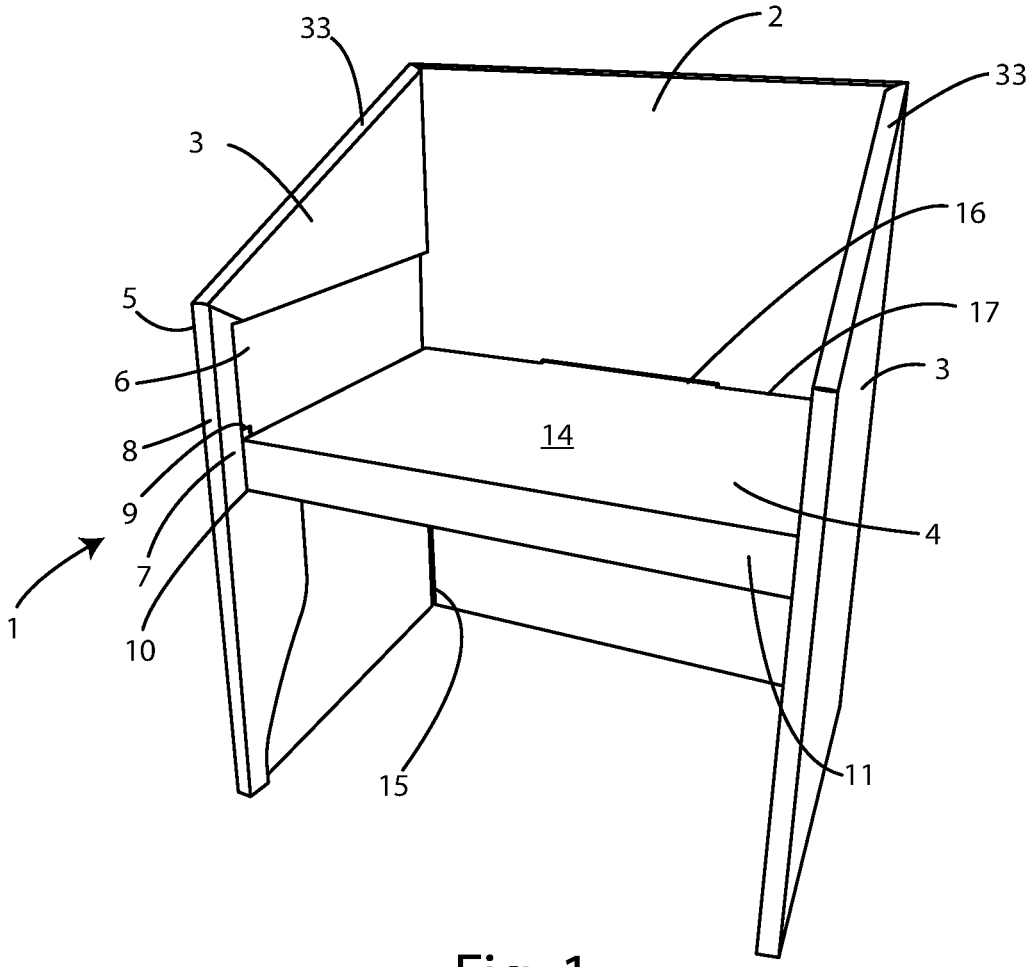
FIG. 1 shows a perspective view of a display unit according to the invention in a first embodiment.

Making reference to FIGS. 1, 2, 3*a*-3*c*, one observes a display unit made of paper or paper-like material denoted by the reference number 1, in a first embodiment.

The papercraft display unit 1 comprises two sidewalls 3 having a rear edge 15, a front edge 8, and an upper edge 33, arranged between said front edge 8 and rear edge 15, a back wall 2 arranged between the two sidewalls 3 at the respective rear edges 15, and at least one shelf 4 arranged transversally to the two walls 2, 3 and associated therewith in order to be locked in position.

Figure 2:
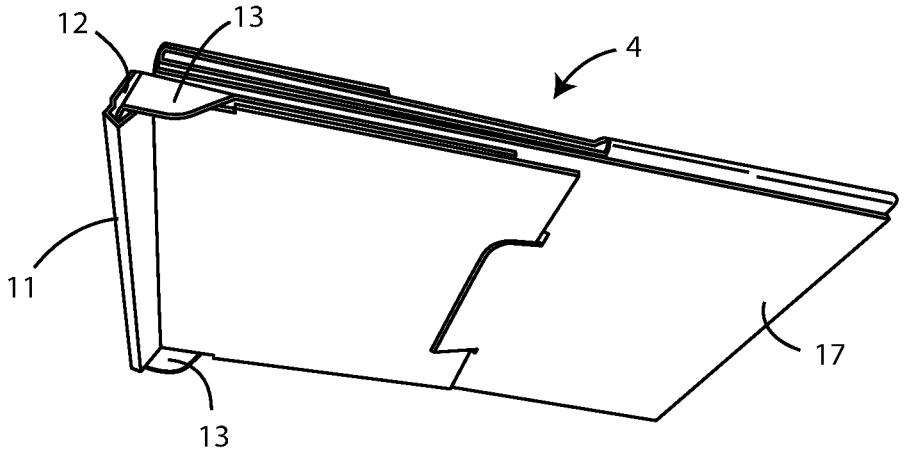
FIG. 2 shows a bottom perspective view of a shelf of the display unit in FIG. 1.

In the embodiments of FIGS. 1-3, the display unit 1 has a single shelf 4, whereas as regards the embodiment of FIGS. 4-7, there are shown blanks for forming a display unit made of paper or paper-like material according to the invention comprising three shelves 4.

The display unit 1 according to the invention can thus comprise a variable number of shelves 4, based on the customer's requirements.

In the display unit 1 according to the invention, each of the two sidewalls 3 comprises, at least at the front edge 8, three layers 5, 6 and 7 of a paper or paper-like material in succession, and, precisely, a first layer or outer layer 5, a second layer or intermediate layer 6, and a third layer or inner layer 7.

The layers 5, 6, and 7 can be three sheets of a same paper or paper-like material or of a different paper or paper-like material, coupled to each other, for example by gluing. Or else, as in the embodiment shown, they can be three different portions of a same blank 3 (shown in FIGS. 4 and 5), which, by means of cuts and folds, is made adapted to form the sidewall 3 of the display unit 1.

The outer layer 5 corresponds to the outer lateral face of the display unit 1.

The intermediate layer or second layer 6 of each of said two sidewalls 3 has at least one intermediate slot 9.

Furthermore, the inner layer 7 of each of said two sidewalls 3 has at least one shaped portion, in particular an indent 10, fashioned so that by coupling the inner layer 7 to the intermediate layer 6, it is in a position corresponding to that of said at least one intermediate slot 9 of the intermediate layer 6.

Figure 3A:
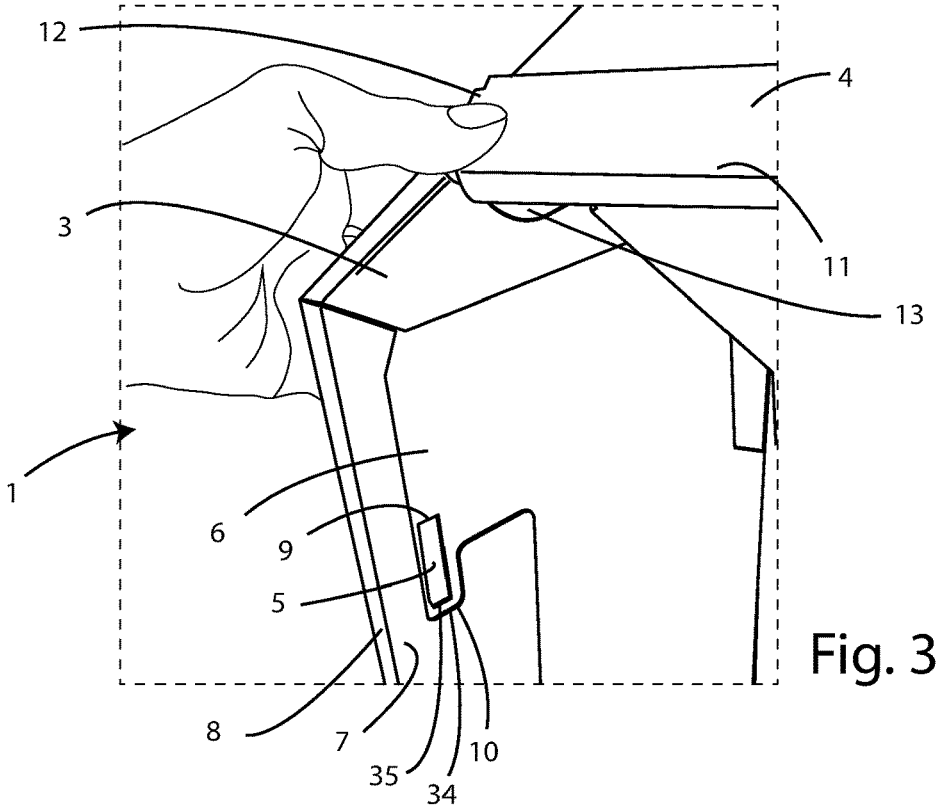
FIG. 3*a* shows steps of assembling the shelf in FIG. 2 to the display unit in FIG. 1.
Figure 3B:
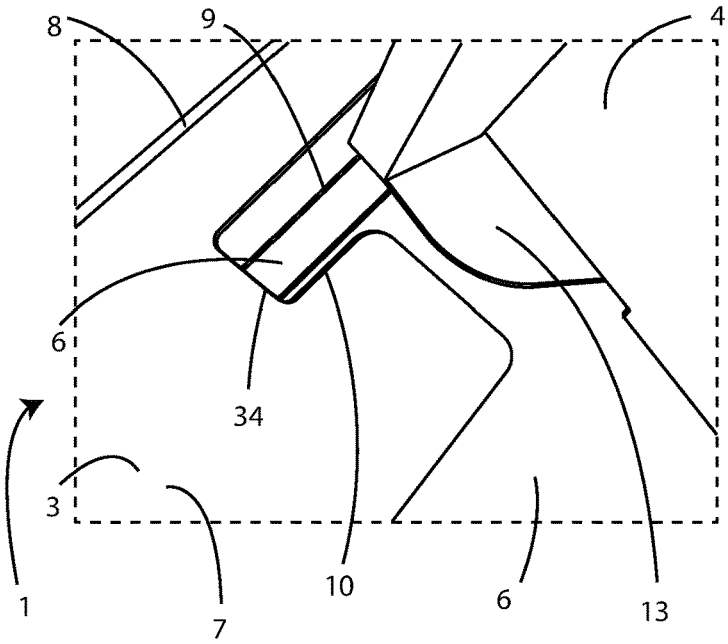
FIG. 3*b* shows steps of assembling the shelf in FIG. 2 to the display unit in FIG. 1.
Figure 3C:
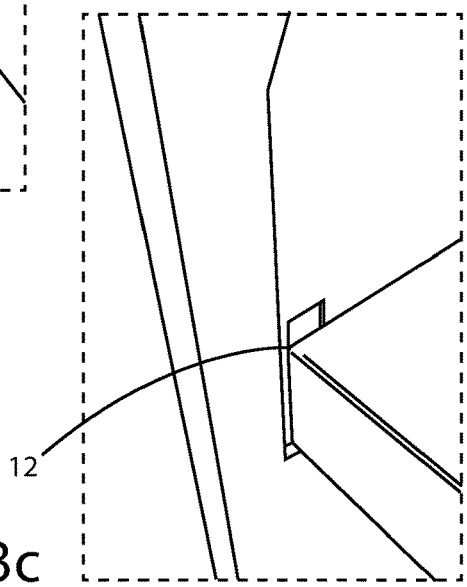
FIG. 3*c* shows steps of assembling the shelf in FIG. 2 to the display unit in FIG. 1.

As shown in FIGS. 3*a*-3*c*, the indent 10 is in a position corresponding to that of said at least one intermediate slot 9, and can have a concavity with the concave portion turned towards said upper edge 33, so as to guide the insertion of the at least one shelf 4 into said intermediate slot 9, said shelf 4 being inserted with a substantially top-down movement.

The at least one shelf 4 has a front edge 11 comprising two protruding side fins 12. The front edge 11 can correspond to the thickness of the shelf 4 itself, or else, as shown in the embodiments of FIGS. 1-3 and 7, it can have a height that is greater than the thickness of the shelf 4, so as to be able to be used, for marketing and product placement purposes, for applying decorations or graphics.

The protruding side fins 12 protrude laterally relative to the width of the shelf 4, as a total or partial extension of the front edge 11.

Each of said two protruding side fins 12 of the shelf 4 is adapted to be inserted into the respective intermediate slot 9 obtained in the intermediate layer 6 of the respective sidewall 3, so that the front edge 11 of the shelf 4 rests laterally on each indent 10 of the inner layer 7 of the respective sidewall 3, laterally locking the shelf 4 in position. The intermediate slot 9 can thus comprise a portion having a perimeter substantially corresponding to at least a portion of the perimeter of the respective side protruding fin 12, said intermediate slot 9 having slightly larger dimensions than said side protruding fin 12, so as to enable the insertion of said side protruding fin 12 into said intermediate slot 9.

This makes it possible to have a structurally valid solution, since the interaction between the indent 10, the intermediate slot 9 of the sidewall 3 and the protruding fin 12 of the shelf 4 imparts structural integrity to the display unit 1 by lending a secure support to the shelf 4 and at the same time ensuring that the shelf 4 is not easily released from its position.

If the display unit 1 comprises two or more shelves 4, the sidewalls 3 will each have a respective intermediate slot 9—indent 10 pair for each shelf 4, distanced from each other in relation to the height at which the shelf 4 will have to be positioned.

Preferably, as shown in FIGS. 2, 3*a*-3*c*, and 7, the shelf 4 can have a side connection element 13 between the front edge 11 and the resting portion 14 of the shelf 4. The side connection element 13 is adapted to be inserted between the inner layer 7 and the intermediate layer 6 at the indent 10 of the sidewall 3 when the shelf 4 is associated with the sidewall 3.

The connection element 13 represents a further structural element capable of preventing the shelf 4 from becoming easily disassembled from the display unit 1, and in particular from the sidewalls 3, due to a lateral movement or impact against the sidewalls 3.

For the purpose of associating the shelf 4 with the rear wall 2 of the display unit 1 according to the invention, in the embodiment shown in FIGS. 1-7 the rear wall 2 comprises a longitudinal fin 16 adapted to be associated with the rear edge 17 of the shelf 4 in order to hold it in position.

The longitudinal fin 16 acts like a lock capable of preventing the shelf 4 from rising upward in the rear part.

Figure 4:
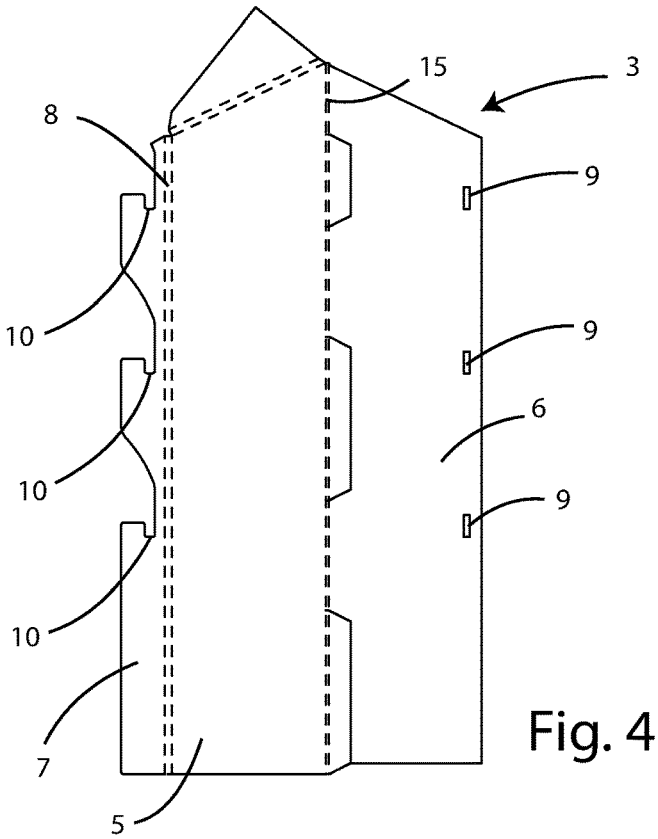
FIG. 4 shows a top view of a first blank for forming a first sidewall or left sidewall of the display unit according to the invention according to a second embodiment.
Figure 5:
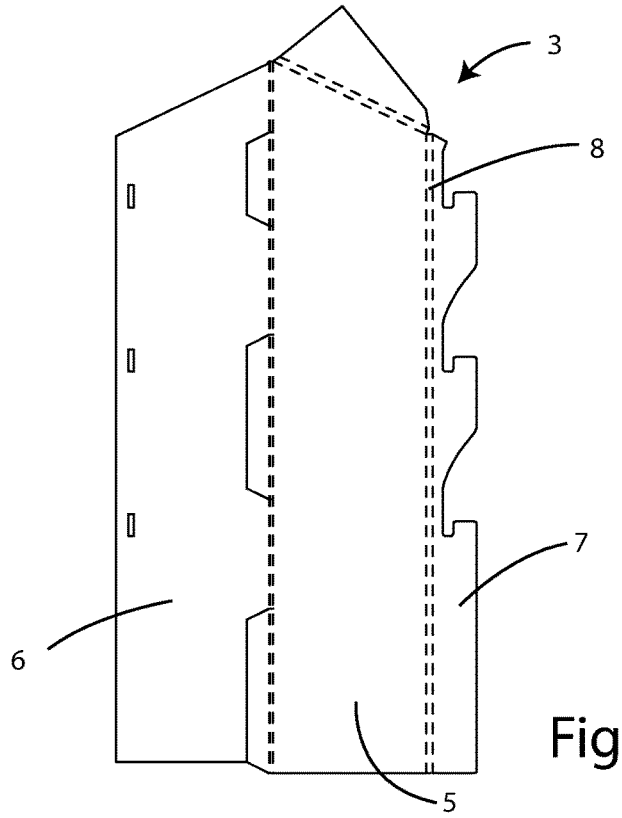
FIG. 5 shows a top view of a second blank for forming a second sidewall or right sidewall of the display unit according to the invention according to a second embodiment.
Figure 6:
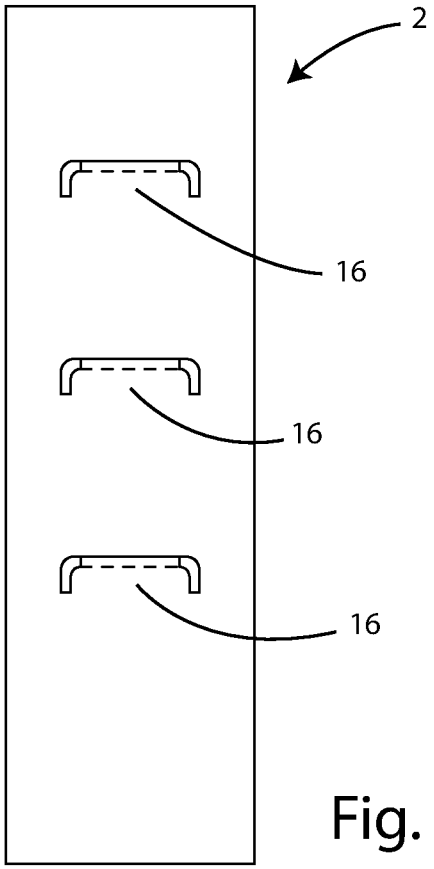
FIG. 6 shows a top view of a third blank for forming the back wall of the display unit according to the invention according to a second embodiment.
Figure 7:
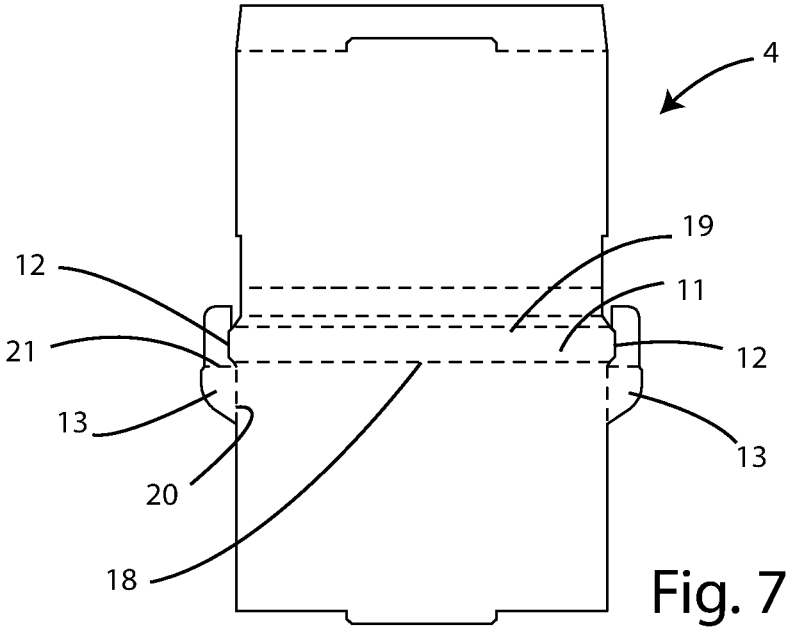
FIG. 7 shows a top view of a fourth blank for forming the shelf of the display unit according to the invention according to a second embodiment.
Figure 8:
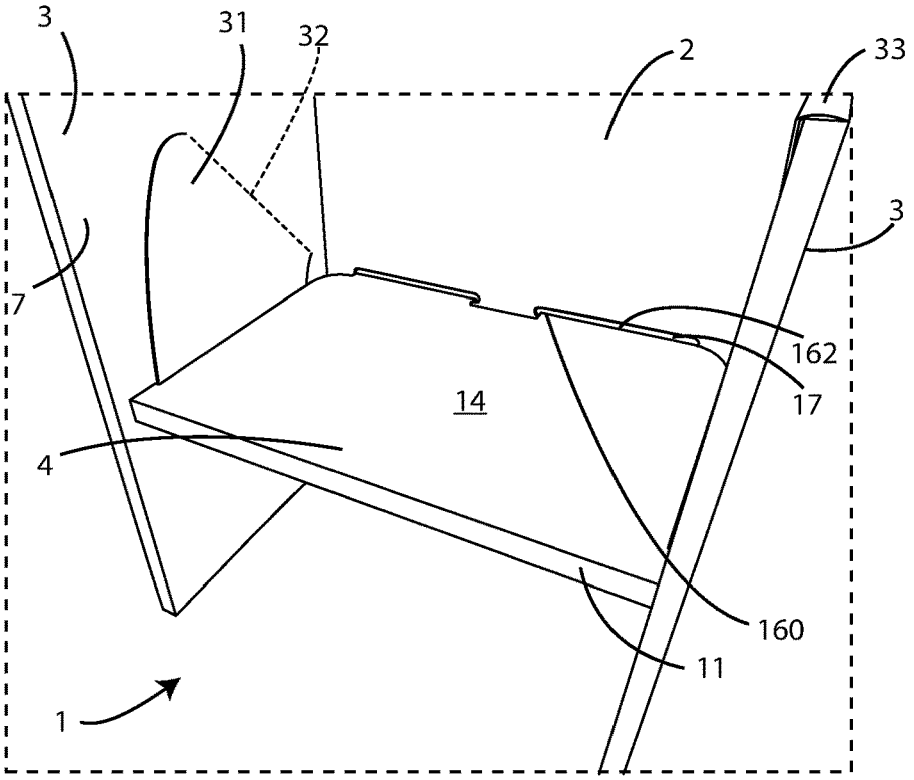
FIG. 8 shows a perspective view of a display unit according to the invention in a third embodiment.
Figure 9A:
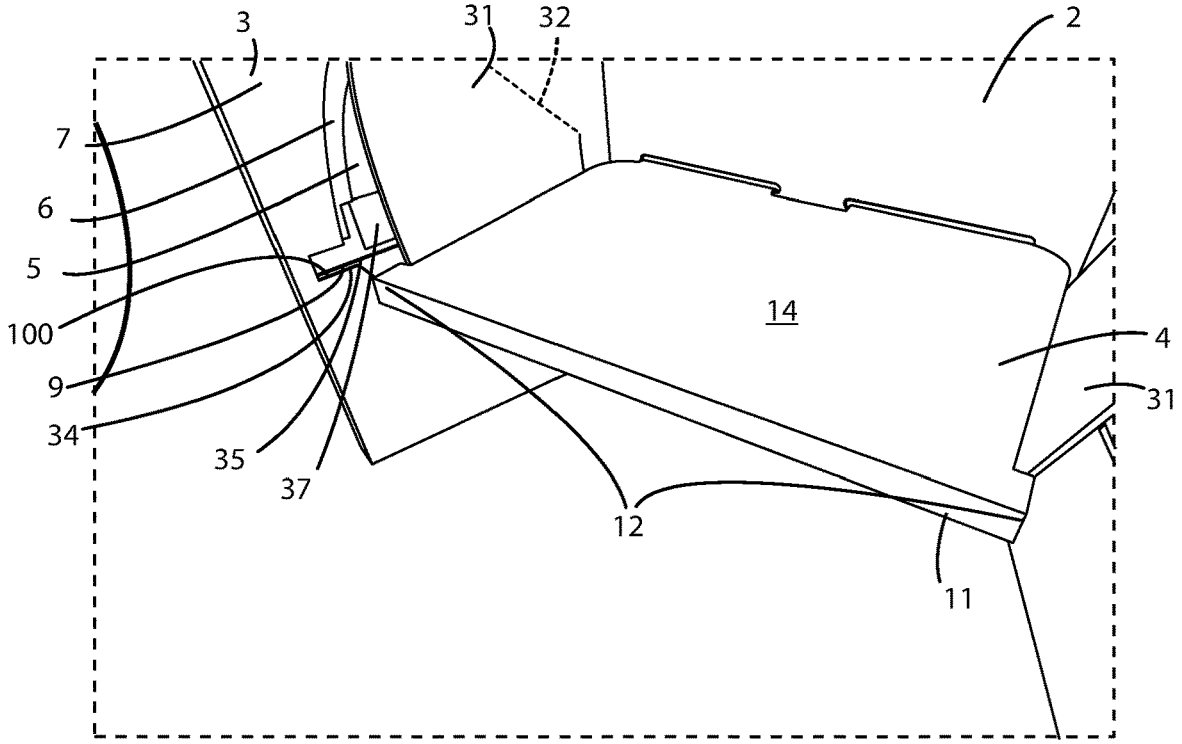
FIG. 9*a* shows a perspective view of the display unit of FIG. 8 in a respective assembly step.
Figure 9B:
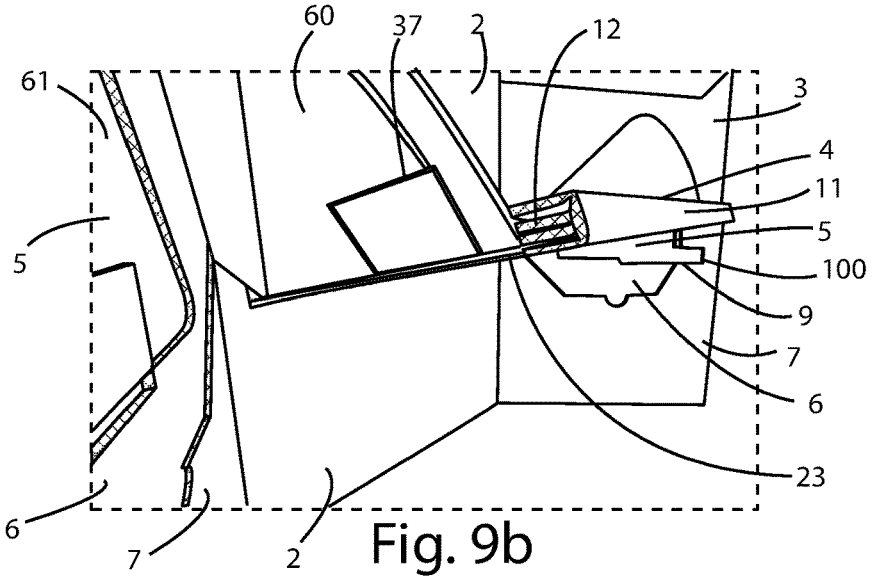
FIG. 9*b* shows a perspective view of the display unit of FIG. 8 in a respective assembly step.
Figure 9C:
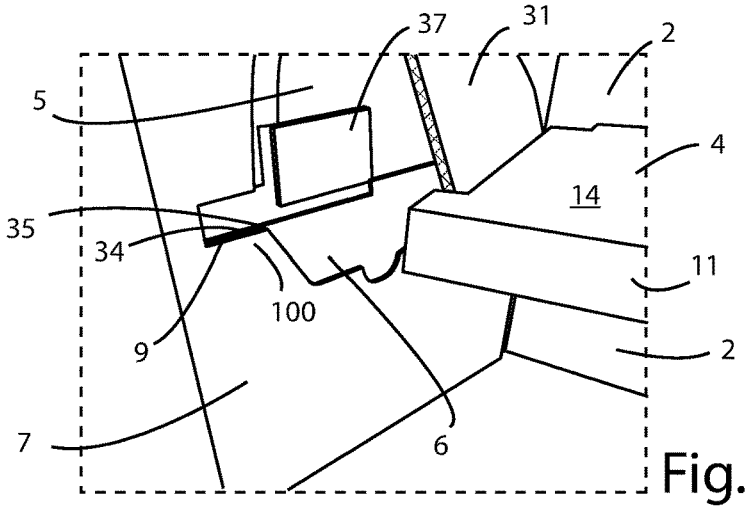
FIG. 9*c* shows a perspective view of the display unit of FIG. 8 in a respective assembly step.
Figure 9D:
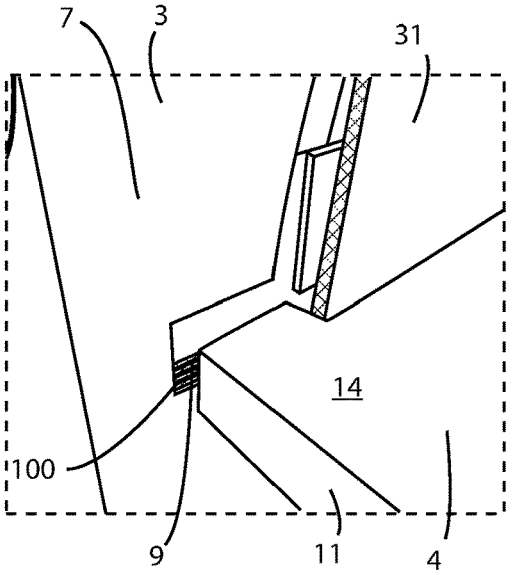
FIG. 9*d* shows a perspective view of the display unit of FIG. 8 in a respective assembly step.
Figure 9E:
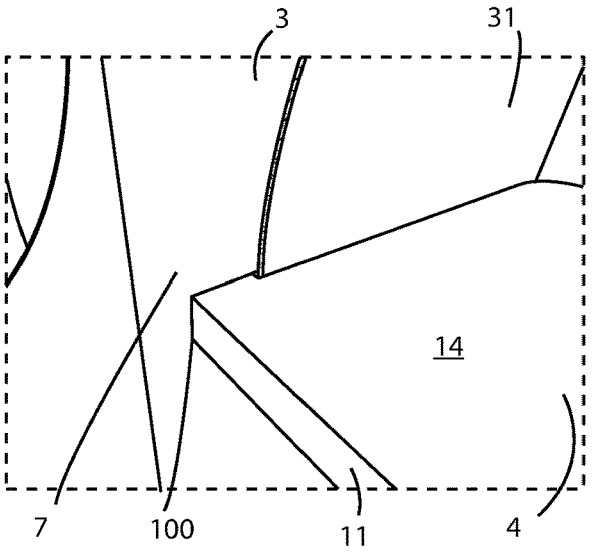
FIG. 9*e* shows a perspective view of the display unit of FIG. 8 in a respective assembly step.
Figure 10:
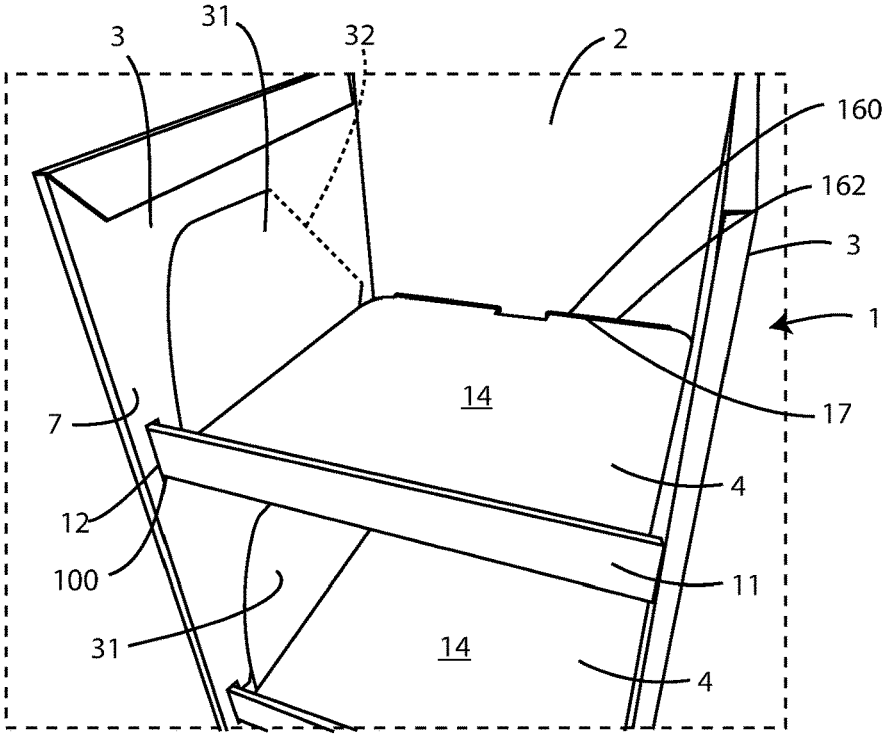
FIG. 10 shows a perspective view of a display unit according to the invention in a fourth embodiment.
Figure 11A:
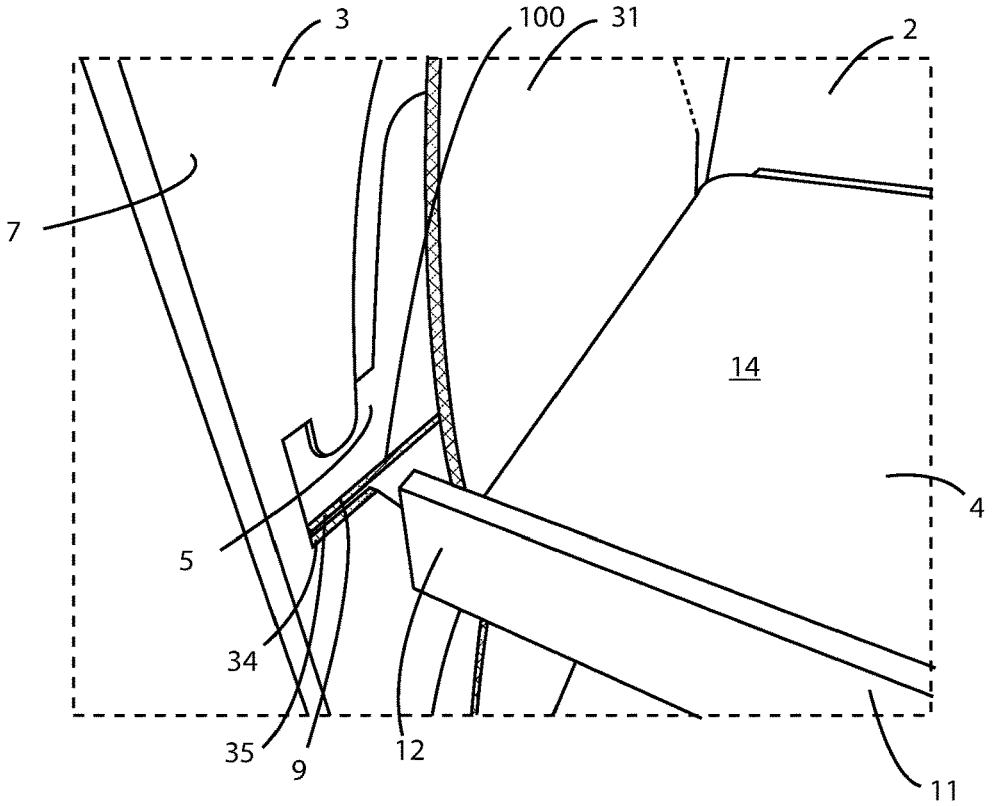
FIG. 11*a* shows a perspective view of the display unit of FIG. 10 in a respective assembly step.
Figure 11B:
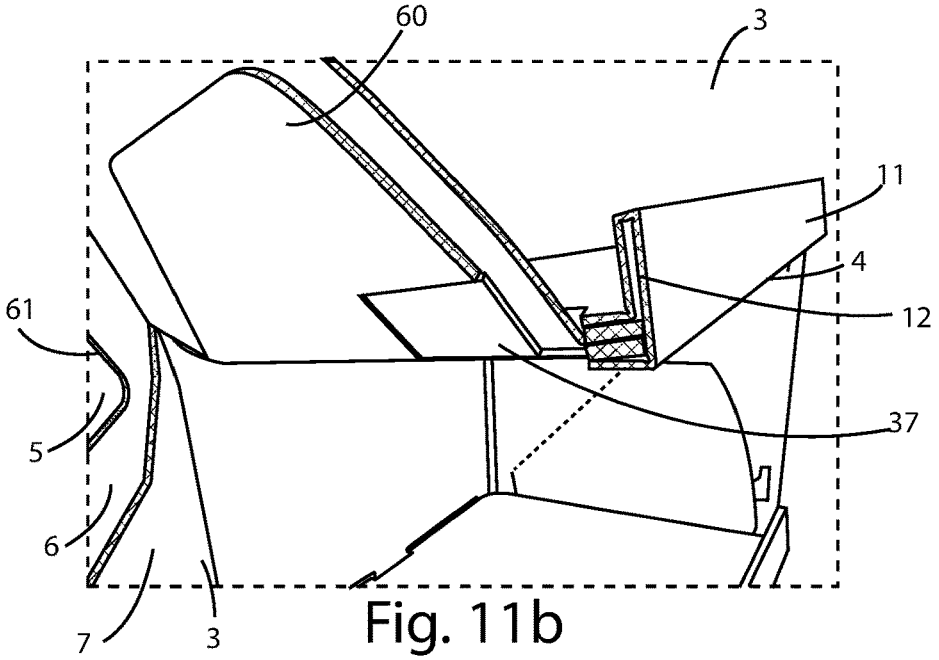
FIG. 11*b* shows a perspective view of the display unit of FIG. 10 in a respective assembly step.
Figure 11C:
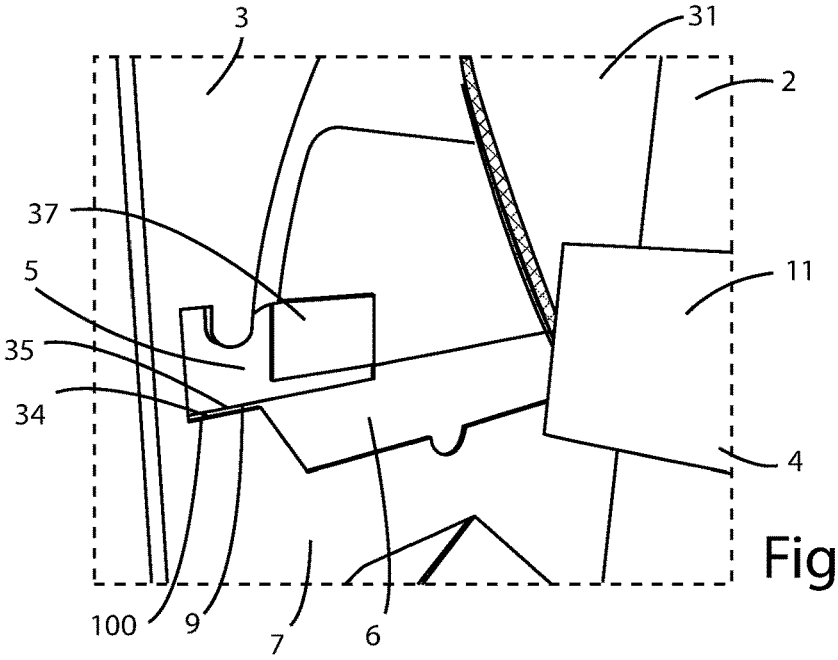
FIG. 11*c* shows a perspective view of the display unit of FIG. 10 in a respective assembly step.
Figure 11D:
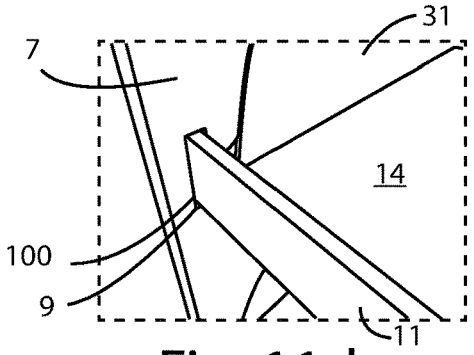
FIG. 11*d* shows a perspective view of the display unit of FIG. 10 in a respective assembly step.
Figure 11E:
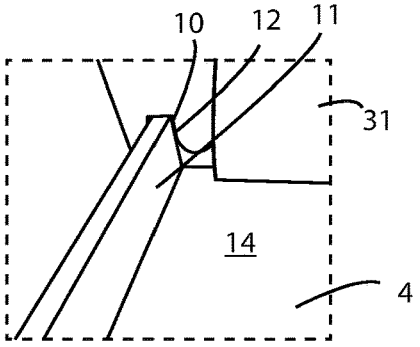
FIG. 11*e* shows a perspective view of the display unit of FIG. 10 in a respective assembly step.
Figure 12:
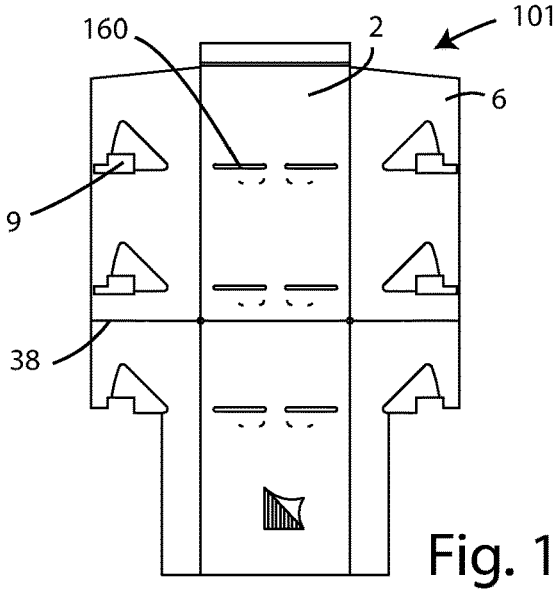
FIG. 12 shows a top view of a first blank for forming the back wall and the intermediate layer of the display unit in FIG. 8.
Figure 13A:
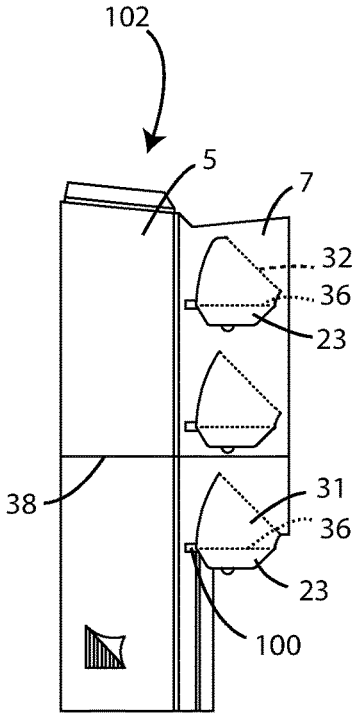
FIG. 13*a* shows a top view of a second and a third blank for forming the inner and outer layers of the two respective sidewalls of the display unit in FIG. 8.
Figure 13B:
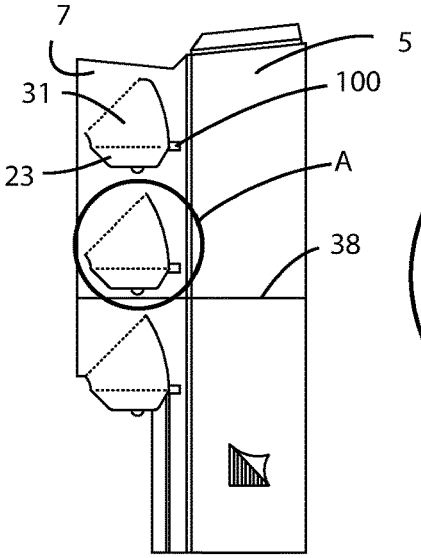
FIG. 13*b* shows a top view of a second and a third blank for forming the inner and outer layers of the two respective sidewalls of the display unit in FIG. 8.
Figure 13C:
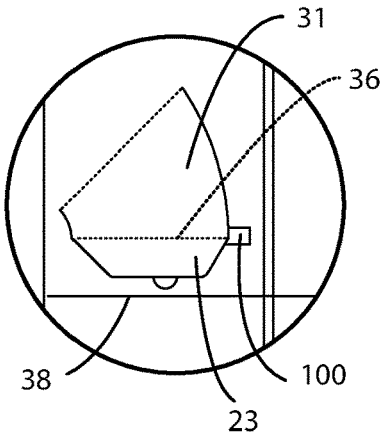
FIG. 13*c* is the detail A of FIG. 13*b;*
Figure 14A:
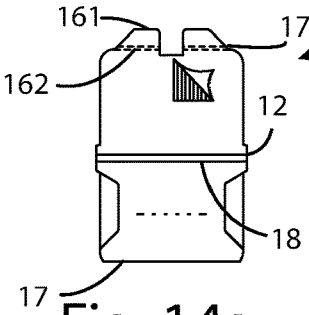
FIG. 14*a* shows a top view of a fourth and a fifth blank for forming, respectively, the outer layers and inner layers of the shelf of the display unit in FIG. 8.
Figure 14B:
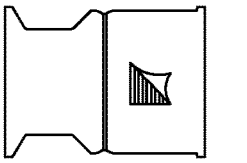
FIG. 14*b* shows a top view of a fourth and a fifth blank for forming, respectively, the outer layers and inner layers of the shelf of the display unit in FIG. 8.
Figure 15:
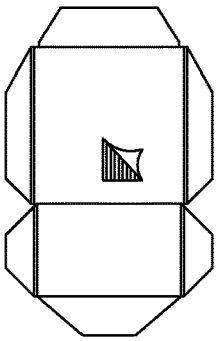
FIG. 15 shows a top view of a sixth blank for forming the lower front portion of the display unit in FIG. 8.
Figure 16:
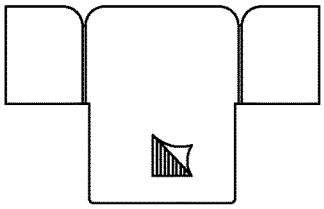
FIG. 16 shows a top view of a seventh blank for forming the upper portion of the display unit in FIG. 8.
Figure 17:
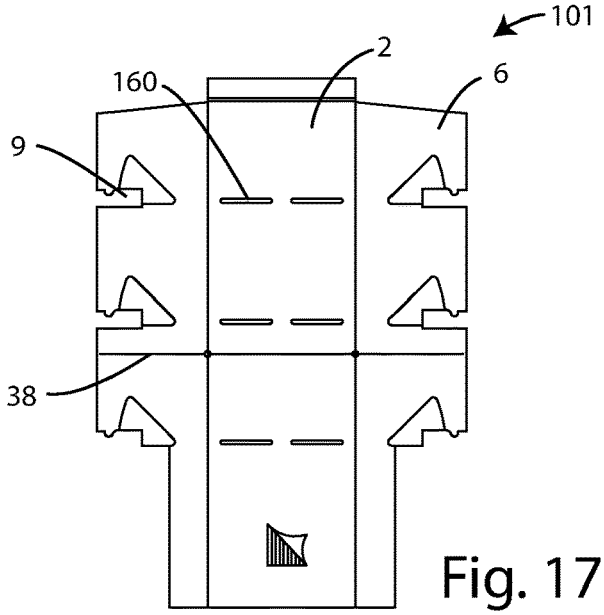
FIG. 17 shows a top view of a first blank for forming the back wall and the intermediate layer of the display unit in FIG. 10.
Figure 18A:
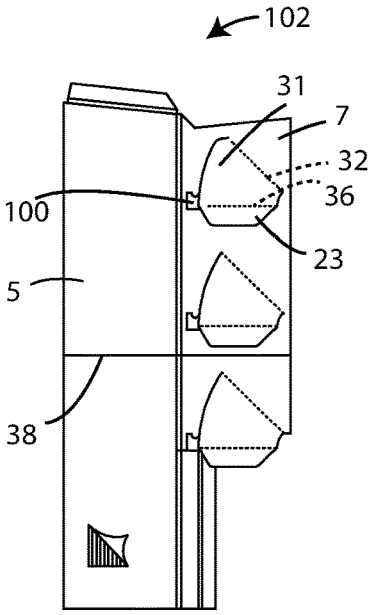
FIG. 18*a* shows a top view of a second and a third blank for forming the inner and outer layers of the two respective sidewalls of the display unit in FIG. 10.
Figure 18B:
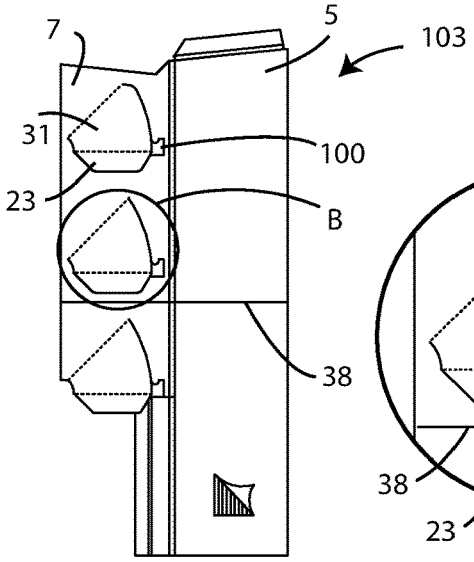
FIG. 18*b* shows a top view of a second and a third blank for forming the inner and outer layers of the two respective sidewalls of the display unit in FIG. 10.
Figure 18C:
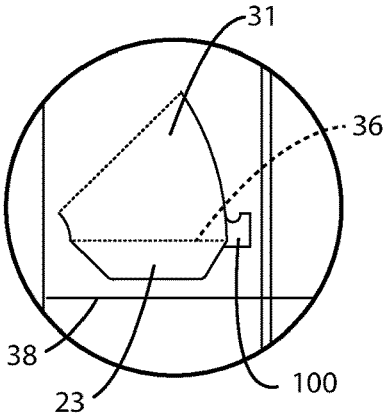
FIG. 18*c* is the detail B of FIG. 18*b;*
Figure 19A:
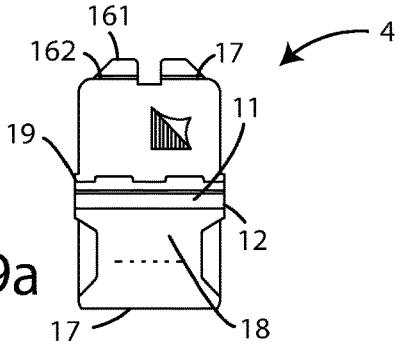
FIG. 19*a* shows a top view of a fourth and a fifth blank for forming, respectively, the outer layers and the inner layers of the shelf of the display unit in FIG. 10.
Figure 19B:
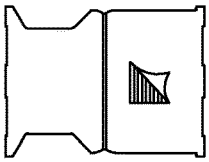
FIG. 19*b* shows a top view of a fourth and a fifth blank for forming, respectively, the outer layers and the inner layers of the shelf of the display unit in FIG. 10.
Figure 20:
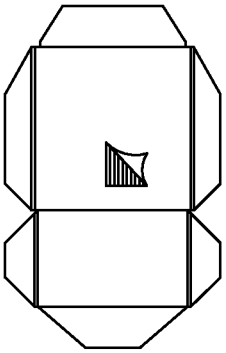
FIG. 20 shows a top view of a sixth blank for forming the lower front portion of the display unit in FIG. 10.
Figure 21:
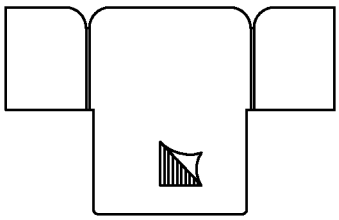
FIG. 21 shows a top view of a seventh blank for forming the upper portion of the display unit in FIG. 10.

The present invention further relates to a first flat blank 3 for forming the sidewall 3 of the display unit 1 described previously. Two embodiments of the first flat blank 3 for forming the right and left sidewalls 3 are shown in FIGS. 4 and 5.

The first blank 3 has an inner face, on said inner face there being obtained two first fold lines 8 and 15, parallel to each other, which divide it into a central panel 5, intended to become the outer layer 5 of the sidewall 3 of the display unit 1, and two side panels 6 and 7 intended to become the intermediate layer 6 and the inner layer 7 of the sidewall 3 of the display unit 1.

The first side panel 6 has at least one intermediate slot 9, and the second side panel 7 has at least one indent 10, arranged so that after folding at the two first creases 8 and 15 with a valley-fold relative to the inner face of the first blank 3, the first side panel 6 is arranged on said central panel 5 and the second side panel 7 is arranged on said first side panel 6 so that said indent 10 is in a position corresponding to that of said at least one intermediate slot 9 of the first side panel 6, and a sidewall 3 of the display unit 1 is obtained.

A second flat blank 2 intended to become the rear or back wall 2 of the display unit 1 according to the invention described previously is shown in FIG. 6.

Said second blank 2 has at least one cut 16, adapted to become the longitudinal fin 16 of the display unit 1 as described previously. Naturally, the number of longitudinal fins 16 will vary based on the number of shelves 4.

A third flat blank 4 according to the invention intended to become the shelf 4 of the display unit 1 according to the invention described previously is shown in FIG. 7.

The third blank 4 has an inner face in which there is obtained at least one fold line 18, in the example two fold lines 18 and 19, parallel to each other. By folding said fold lines 18 and 19 with a mountain-fold according to the inner face one obtains the shelf 4 according to the invention, wherein the edge 11 can correspond to said fold line or is bordered by said fold lines 18 and 19.

Furthermore, the width of the edge 11 is greater than the rest of the third blank 4, so as to form the two protruding fins 12 of the shelf 4 of the display unit 1 according to the invention.

Preferably, the shelf 4 of the display unit 1 can comprise a longitudinal fin 13 at the front edge 11 adapted to become the connection element 13.

The longitudinal fin 13 has two creases 20 and 21, orthogonal to each other, so that when the third blank 4 is assembled into the shelf 4, one portion of the longitudinal fin 13 is locked between the edge 11 and the resting surface 14 of the shelf 4 and the other portion forms the connection element 13.

Making reference to FIGS. 8-9 and 12-16, one observes a display unit made of paper or paper-like material (in FIGS. 8 and 9), indicated by the reference number 1, and associated blanks (in FIGS. 12-16) in a third embodiment, whereas making reference to FIGS. 10-11 and 17-21, a display unit made of paper or paper-like material (in FIGS. 10 and 11) and associated blanks (in FIGS. 17-21) in a fourth embodiment are shown.

Hereinafter, the technical features in common with the embodiments of the display unit according to the invention described previously will be denoted by the same reference numbers.

In particular, in said third and fourth embodiments of the commercial display unit, the body of said commercial display unit 1 is made starting from 3 blanks, represented in FIGS. 12-13 and 17-18, wherein a first blank 101 is adapted to form the back wall 2 and the intermediate layer 6 of the sidewall 3 of said display unit 1, whereas a second blank 102 and a third blank 103 are adapted to form the outer layer 5 and the inner layer 7 of said sidewall 3, after having been appropriately folded and coupled, preferably glued, on the portion adapted to form said intermediate layer 6 of said first blank 101. Said shelf 4, by contrast, is obtained by appropriately folding and coupling two blanks, both represented in FIG. 14 as well as in FIG. 19, so that said shelf 4 comprises four layers of a paper or paper-like material.

In these embodiments, furthermore, said back wall 2 can have longitudinal slots 160 adapted to receive longitudinal fins 161 placed on said shelf 4 and comprising fold lines 162 at said rear edge 17 of the shelf 4, in such a way as to fold over relative thereto.

Again in these embodiments, said inner layer 7 of each sidewall 3 has an inner fin 31, obtained by means of cuts and folds of said inner layer 7, for each shelf 4. In particular, each inner fin 31 has an edge 32 in common with said inner layer 7, which consists in a fold line 32 of said inner layer 7, whereas the other edges are obtained from cuts made on said inner layer 7.

A terminal portion 23 of each inner fin 31, defined by a further fold line 36, is adapted to be inserted and being coupled inside an intermediate space between said four layers of the shelf 4, irremovably coupling the shelf 4 to the sidewall 3.

In the embodiments shown in FIGS. 8-11 the shaped portion is an inner slot 100 obtained on said inner layer 7. Said inner slot 100 has at least one lower edge portion 34 that is coplanar with a lower edge portion 35 of said intermediate slot 9, so that at least a portion of said protruding side fins 12 rests at least on a portion of both said lower edges 34, 35.

Furthermore, said inner fins 31 can comprise a further intermediate layer 60 of paper or paper-like material, adapted to be inserted in specific slots 61 obtained on said intermediate layer 6 of said sidewalls 3. Each further intermediate layer 60 of said inner fins 31 can be obtained by means of specific cuts from said intermediate layer 6 of the respective sidewall 3, forming the associated slot 61.

Furthermore, the coupling between said inner fins 31 and said sidewalls 3 can be rendered more stable by means of a magnetic coupling means 37, consisting, for example, of pairs of magnetic elements with opposite polarity or pairs of magnetic elements and ferromagnetic elements couplable to each other.

In particular, said magnetic coupling means can be respectively positioned on said slots 61 of said intermediate layer 6 of the sidewalls 3 and on said further intermediate layer 60 of said inner fins 31. Said magnetic coupling means 37 advantageously make it possible to improve the stability of the display unit 1, when formed.

Figure 22A:
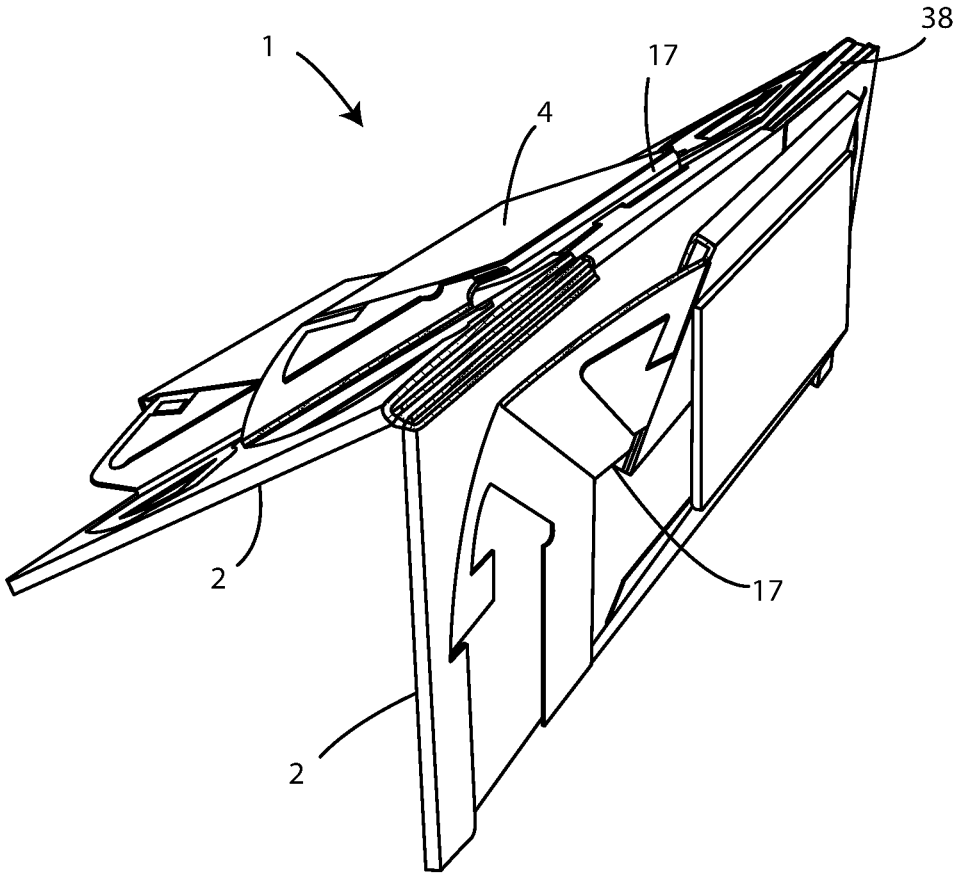
FIG. 22*a* shows perspective view of various steps of folding the display unit of FIG. 8.
Figure 22B:
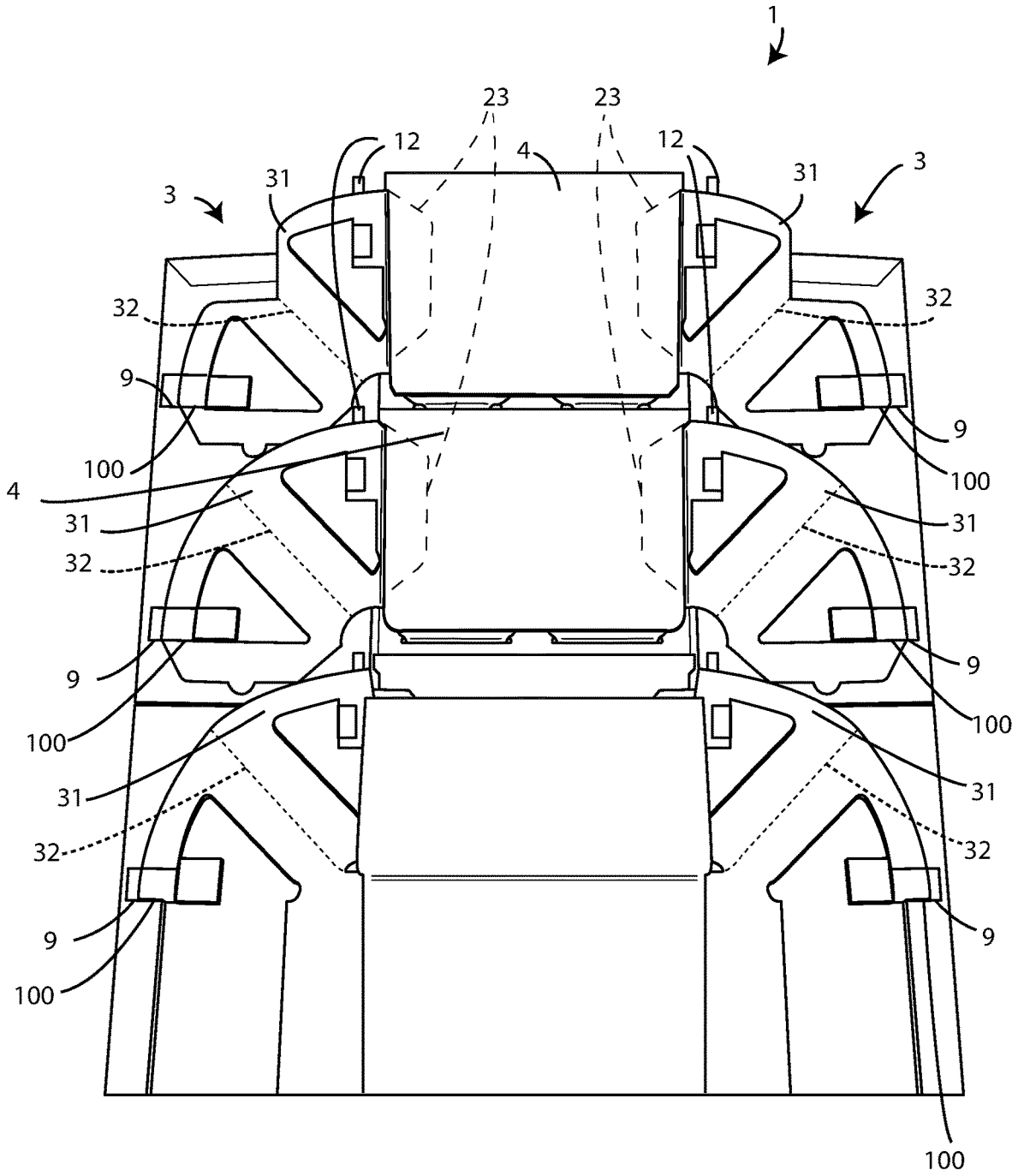
FIG. 22*b* shows perspective view of various steps of folding the display unit of FIG. 8.
Figure 22C:
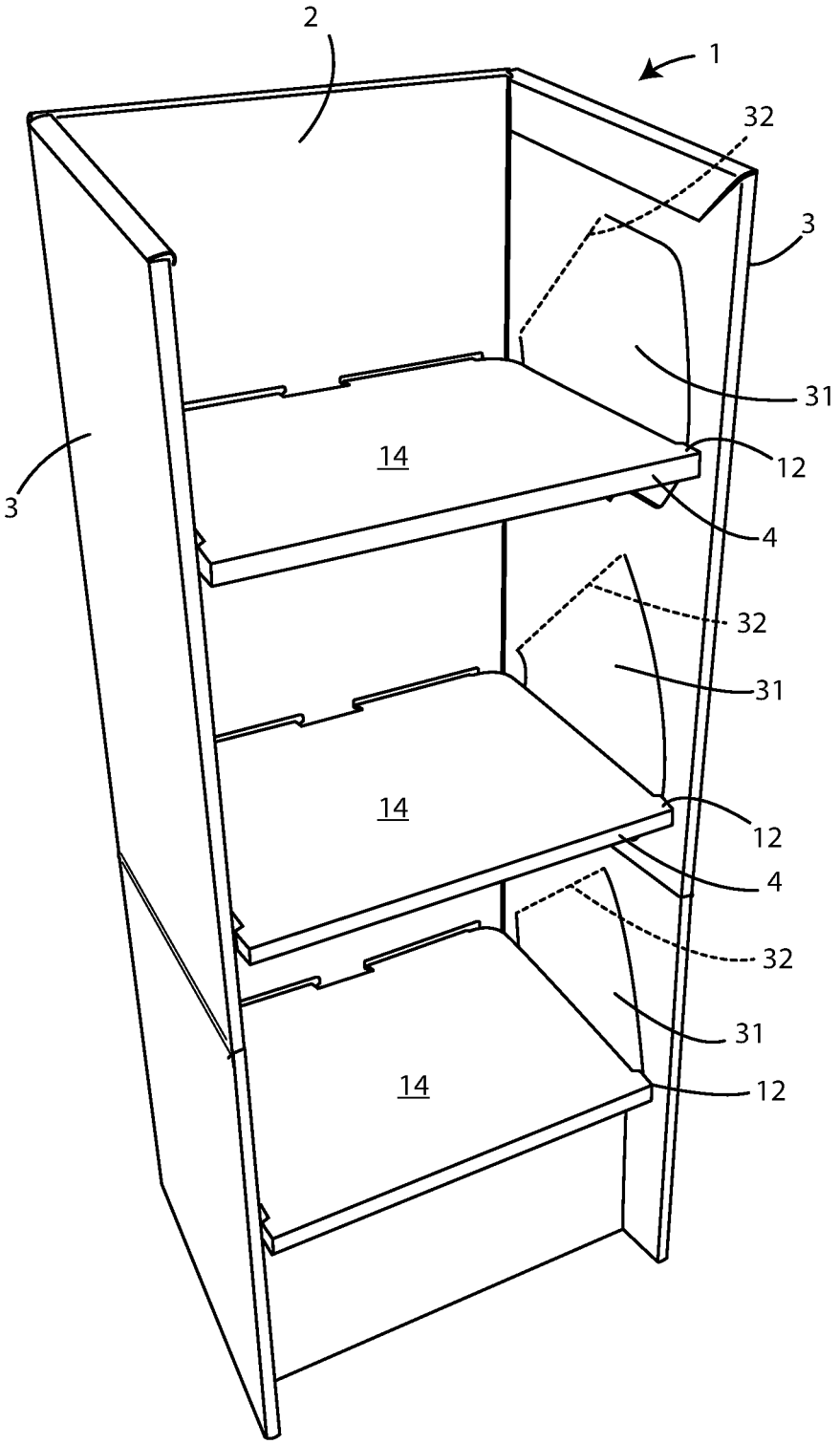
FIG. 22*c* shows perspective view of various steps of folding the display unit of FIG. 8.

Finally, in said third and fourth embodiments, said display unit 1 is obtained with a single movement that makes it pass from a first folded configuration (shown in FIG. 22*b*), wherein each sidewall 3 and each said at least one shelf 4 are substantially parallel to or coplanar with the back wall 2, to a second configuration of use (shown in FIG. 22*c*), wherein said sidewalls 3 are substantially transversal to said back wall 2 and each shelf 4 is substantially transversal both to said back wall 2 and to said sidewalls 3.

In particular, during said single movement, said sidewalls 3 move with a substantially lateral movement so that each pair of slots 9 and 100 of the sidewalls 3 locks within it the portion of said protruding side fins 12 of the respective shelf 4.

Furthermore, each shelf 4 moves with a substantially top-down movement towards the configuration of use of the display unit 1; in particular, the inner fins 31 pass from being substantially parallel to the support surface 14 of the shelf 4 and to the surface of the sidewalls 3 folded along the fold line 32, to being housed in the respective portion of the inner slot 100 and substantially transversal to the support surface 14 of the respective shelf 4 folded along the fold line 36.

In addition, the display unit 1 can take on a third rest configuration (shown in FIG. 22*a*), wherein the display unit 1, from the folded configuration, is further folded relative to a further fold line 38 substantially parallel to the rear edge 17 of each shelf 4, until obtaining two portions of the outer face of the back wall 2 substantially parallel.

This rest configuration is obtained by folding with a mountain-fold the display unit 1 from the folded configuration relative to the inner face of the back wall 2.

In this configuration the display unit is advantageously convenient to store and occupies minimal space for its transport.

In the foregoing, the preferred embodiments have been described and variants of the present invention have been suggested, but it is understood that persons skilled in the art may apply modifications and changes without going outside the scope of protection hereof, as defined by the appended claims.

The invention claimed is:

1. A papercraft display unit comprising:

two sidewalls each having a rear edge and a front edge, a back wall arranged between the two sidewalls at the respective rear edges, and at least one shelf arranged transversally to said walls and associated therewith so as to be locked in position, wherein said display unit further comprises:

each of said sidewalls comprises, at least at the front edge, three layers of a paper or paper-like material in succession, and precisely, a first layer or outer layer, a second layer or intermediate layer, and a third layer or inner layer, said intermediate layer of each of said two sidewalls has at least one intermediate slot, said inner layer of each of said two sidewalls has at least one shaped portion in correspondence of said at least one intermediate slot of said intermediate layer, said at least one shelf has a front edge comprising two protruding side fins, and each of said two protruding side fins of said shelf is adapted to be inserted in at least a first portion of the respective intermediate slot obtained in the intermediate layer of the respective sidewall, so that the front edge of the shelf rests laterally at least on a portion of the lower edge of each shaped portion of the inner layer of the respective sidewall, wherein each said shaped portion is an indent and said shelf is adapted to be inserted in the respective intermediate slot so that the front edge of the shelf rests laterally on each indent of the inner layer of the respective sidewall, laterally locking the shelf in position, said at least one shelf has at least one side connection element between the front edge and the resting portion of the shelf, said at least one side connection element being adapted to be inserted between the inner layer and the intermediate layer at the indent of the respective sidewall when the shelf is associated with the sidewall, and wherein each sidewall has an upper edge arranged between said front edge and rear edge, said indent has a concavity with the concave portion turned towards said upper edge so as to guide, with a substantially top-down movement, the insertion of said shelf into said intermediate slot.

2. A papercraft display unit comprising:

two sidewalls each having a rear edge and a front edge, a back wall arranged between the two sidewalls at the respective rear edges, and at least one shelf arranged transversally to said walls and associated therewith so as to be locked in position, wherein said display unit further comprises:

each of said sidewalls comprises, at least at the front edge, three layers of a paper or paper-like material in succession, and precisely, a first layer or outer layer, a second layer or intermediate layer, and a third layer or inner layer, said intermediate layer of each of said two sidewalls has at least one intermediate slot, said inner layer of each of said two sidewalls has at least one shaped portion in correspondence of said at least one intermediate slot of said intermediate layer, said at least one shelf has a front edge comprising two protruding side fins, and each of said two protruding side fins of said shelf is adapted to be inserted in at least a first portion of the respective intermediate slot obtained in the intermediate layer of the respective sidewall, so that the front edge of the shelf rests laterally at least on a portion of the lower edge of each shaped portion of the inner layer of the respective sidewall, wherein said shaped portion is an inner slot, said at least one lower edge portion of said inner slot is coplanar with a lower edge portion of said intermediate slot, so that at least a portion of said protruding side fins rests at least on a portion of both said lower edges, and said sidewalls are configured so as to facilitate the insertion of said shelf into said inner slot and intermediate slot with a lateral movement from a substantially open position, wherein said sidewalls are substantially coplanar with a said back wall, to a final position wherein said sidewalls are substantially transversal to said back wall.

3. The display unit according to claim 2, wherein said inner layer of each sidewall comprises at least one inner fin for each shelf, said at least one inner fin comprising a terminal portion, and in that said at least one shelf is formed by at least two layers of a paper or paper-like material, said terminal portion of said at least one inner fin being inserted inside the space between said at least two layers.

4. The display unit according to claim 3, wherein said at least one inner fin is obtained by cuts and folds of said inner layer, said inner fin having at least one fold line in common with said inner layer.

5. The display unit according to claim 3, wherein fixed on said inner fins there is a further intermediate layer of a paper or paper-like material which is adapted to be inserted into slots obtained on said intermediate layer of said sidewalls.

6. The display unit according to claim 5, wherein said further intermediate layer of said inner fins and the respective slots comprise magnetic coupling means adapted to stabilise said display unit, when formed.

7. The display unit according to claim 1, wherein said layers are three sheets of a same paper or paper-like material or of a different paper or paper-like material coupled to each other.

8. The display unit according to claim 1, wherein said layers are three different portions of a same blank which, by means of cuts and folds, is adapted to form the sidewall of the display unit.

9. The display unit according to claim 1, wherein the front edge of each at least one shelf corresponds to the thickness of the shelf itself.

10. The display unit according to claim 1, wherein the front edge of each at least one shelf has a greater height than the thickness of the shelf, so that the front edge of each at least one shelf can be used for applying decorations or graphics.

11. The display unit according to claim 1, wherein the protruding side fins of each at least one shelf protrude laterally relative to the width of the shelf, as a total or partial extension of the front edge.

12. The display unit according to claim 1, wherein the display unit comprises two or more shelves, and in that each sidewall has a respective slot-shaped portion pair for each shelf, distanced from each other in relation to the height at which the shelf is positioned.

13. The display unit according to claim 1, wherein a rear wall comprises a longitudinal fin adapted to be associated with the rear edge of the shelf so as to hold the shelf in position.

14. A kit of flat blanks for forming a papercraft display unit comprising two sidewalls each having a rear edge and a front edge, a back wall arranged between the two sidewalls at the respective rear edges, and at least one shelf arranged transversally to said walls and associated therewith so as to be locked in position, wherein said display unit further comprises each of said sidewalls comprises, at least at the front edge, three layers of a paper or paper-like material in succession, and precisely, a first layer or outer layer, a second layer or intermediate layer, and a third layer or inner layer, said intermediate layer of each of said two sidewalls has at least one intermediate slot, said inner layer of each of said two sidewalls has at least one shaped portion in correspondence of said at least one intermediate slot of said intermediate layer, said at least one shelf has a front edge comprising two protruding side fins, and each of said two protruding side fins of said shelf is adapted to be inserted in at least a first portion of the respective intermediate slot obtained in the intermediate layer of the respective sidewall, so that the front edge of the shelf rests laterally at least on a portion of the lower edge of each shaped portion of the inner layer of the respective sidewall, said kit of blanks comprising:

a first flat blank for forming a sidewall, said first blank having an inner face, there being obtained on said inner face two first fold lines, parallel to each other, which divide the first flat blank into a central panel, intended to become the outer layer of the sidewall of the display unit, and two side panels that becomes the intermediate layer and the inner layer of the sidewall of the display unit, said first side panel having at least one slot, and the second side panel having at least one shaped portion, arranged so that after folding the two first creases with a valley-fold relative to the inner face of the first blank, the first side panel is arranged on said central panel and the second side panel is arranged on said first side panel so that said indent is in correspondence of said at least one slot of the first side panel, obtaining a sidewall of the display unit, a second flat blank that becomes the rear or back wall of said display unit, said second flat blank having at least one cut, adapted to become the longitudinal fin of the display unit, and a third flat blank that becomes the at least one shelf of said display unit, said third blank having an inner face wherein at least one fold line is obtained, and in that the shelf is obtained by folding said at least one fold line with a mountain-fold relative to the inner face, wherein the edge corresponds to at least one fold line.

15. The kit of flat blanks according to claim 14, wherein the width of the edge of said third flat blank is greater than the rest of the body of the third blank, so as to form the two protruding fins of the shelf of the display unit.

16. The kit of flat blanks according to claim 14, wherein said third flat blank comprises a longitudinal fin at the front edge adapted to become the connection element of the shelf of the display unit, and in that the longitudinal fin has two creases orthogonal to each other, so that when the third blank is assembled into a shelf, a portion of the longitudinal fin is locked between the edge and the resting surface of the shelf and the other portion forms the connection element.

17. The display unit according to claim 3, wherein said layers are three sheets of a same paper or paper-like material or of a different paper or paper-like material coupled to each other.

18. The display unit according to claim 3, wherein said layers are three different portions of a same blank which, by means of cuts and folds, is adapted to form the sidewall of the display unit.

19. The display unit according to claim 3, wherein the front edge of each at least one shelf corresponds to the thickness of the shelf itself.

20. The display unit according to claim 3, wherein the front edge of each at least one shelf has a greater height than the thickness of the shelf, so that the front edge of each at least one shelf can be used for applying decorations or graphics.

21. The display unit according to claim 3, wherein the protruding side fins of each at least one shelf protrude laterally relative to the width of the shelf, as a total or partial extension of the front edge.

22. The display unit according to claim 3, wherein the display unit comprises two or more shelves, and in that each sidewall has a respective slot-shaped portion pair for each shelf, distanced from each other in relation to the height at which the shelf is positioned.

23. The display unit according to claim 3, wherein a rear wall comprises a longitudinal fin adapted to be associated with the rear edge of the shelf so as to hold the shelf in position.

* * * * *